US011280351B2

(12) United States Patent
Tokuno

(10) Patent No.: US 11,280,351 B2
(45) Date of Patent: Mar. 22, 2022

(54) BLOWER

(71) Applicant: Nidec Corporation, Kyoto (JP)

(72) Inventor: Yuta Tokuno, Kyoto (JP)

(73) Assignee: NIDEC CORPORATION, Kyoto (JP)

( * ) Notice: Subject to any disclaimer, the term of this patent is extended or adjusted under 35 U.S.C. 154(b) by 112 days.

(21) Appl. No.: 16/885,320

(22) Filed: May 28, 2020

(65) Prior Publication Data

US 2020/0378403 A1 Dec. 3, 2020

(30) Foreign Application Priority Data

May 31, 2019 (JP) ..... JP2019-103113

(51) Int. Cl.

| | |
|---|---|
| ***F04D 29/52*** | (2006.01) |
| ***F04D 29/26*** | (2006.01) |
| ***F04D 19/00*** | (2006.01) |
| *F04D 19/02* | (2006.01) |

(52) U.S. Cl.

CPC ..... *F04D 29/522* (2013.01); *F04D 19/002* (2013.01); *F04D 29/263* (2013.01); *F04D 19/024* (2013.01)

(58) Field of Classification Search

CPC .... F04D 29/522; F04D 19/002; F04D 29/263; F04D 19/024; F04D 25/08; F04D 2260/36; F04D 29/646; F04D 19/007; F04D 25/166

See application file for complete search history.

(56) References Cited

U.S. PATENT DOCUMENTS

2008/0286135 A1* 11/2008 Yoshida ..... F04D 29/646 417/423.5

FOREIGN PATENT DOCUMENTS

JP 3959359 B2 8/2007

* cited by examiner

*Primary Examiner* — Aaron R Eastman
(74) *Attorney, Agent, or Firm* — Keating & Bennett

(57) ABSTRACT

A blower includes a first fan, a second fan axially below the first fan, and a tubular housing accommodating the first fan and the second fan. The housing includes an upper tubular portion accommodating the first fan, a lower tubular portion accommodating the second fan, a first fan support at an axially lower end portion of the upper tubular portion to support the first fan, and a second fan support at an axially upper end portion of the lower tubular portion to support the second fan. The housing is separable into a first structure including the first upper tubular divided body, the first lower tubular divided body, and the first fan support, and a second structure including the second upper tubular divided body, the second lower tubular divided body, and the second fan support.

11 Claims, 11 Drawing Sheets

BLOWER

CROSS REFERENCE TO RELATED APPLICATION

The present application claims priority under 35 U.S.C. § 119 to Japanese Application No. 2019-103113 filed on May 31, 2019, the entire contents of which are incorporated herein by reference.

1. FIELD OF THE INVENTION

The present disclosure relates to a blower.

2. BACKGROUND

For example, a counter-rotating axial flow fan in which two (plural) single axial flow fans are connected axially is known. The counter-rotating axial flow fan has a large air volume and a high static pressure, and thus enables increase in cooling efficiency of an electric device having a small space in which air flows.

Unfortunately, the above-described counter-rotating axial flow fan is configured such that the single axial flow fans have individual cases that are coupled to each other. Thus, to couple the cases to each other, there is required not only an operation to allow the cases to come close to each other and come contact with each other, but also an operation to rotate one case with respect to the other case.

SUMMARY

A blower according to an example embodiment of the present disclosure includes a first fan to generate an airflow flowing in a direction along a central axis extending vertically, a second fan that is disposed axially below and coaxially with the first fan, and a housing with a tubular shape that extends along the central axis and accommodates the first fan and the second fan. The housing includes an upper tubular portion accommodating the first fan, a lower tubular portion accommodating the second fan, a first fan support that is disposed at an axially lower end portion of the upper tubular portion to support the first fan, and a second fan support that is disposed at an axially upper end portion of the lower tubular portion to support the second fan. The upper tubular portion is circumferentially separable into a first upper tubular divided body and a second upper tubular divided body. The lower tubular portion is circumferentially separable into a first lower tubular divided body and a second lower tubular divided body. The housing is separable into a first structure including the first upper tubular divided body, the first lower tubular divided body, and the first fan support, and a second structure including the second upper tubular divided body, the second lower tubular divided body, and the second fan support.

The above and other elements, features, steps, characteristics and advantages of the present disclosure will become more apparent from the following detailed description of the example embodiments with reference to the attached drawings.

DETAILED DESCRIPTION

Hereinafter, example embodiments of the present disclosure will be described in detail with reference to the drawings. In the present specification, a direction parallel to a central axis of a blower 100 is referred to as an "axial direction", "axial", or "axially", a direction orthogonal to a central axis J1 of the blower 100 is referred to as a "radial direction", "radial", or "radially", and a direction along a circular arc about the central axis J1 of the blower 100 is referred to as a "circumferential direction", "circumferential", or "circumferentially". In the blower 100, the axial direction is defined as a vertical direction, and upper and lower sides are defined based on the state illustrated in FIG. 1. The vertical direction is a name that is used for the sake of explanation, and does not limit a positional relationship and a direction of the blower 100 when in use.

Figure 1:
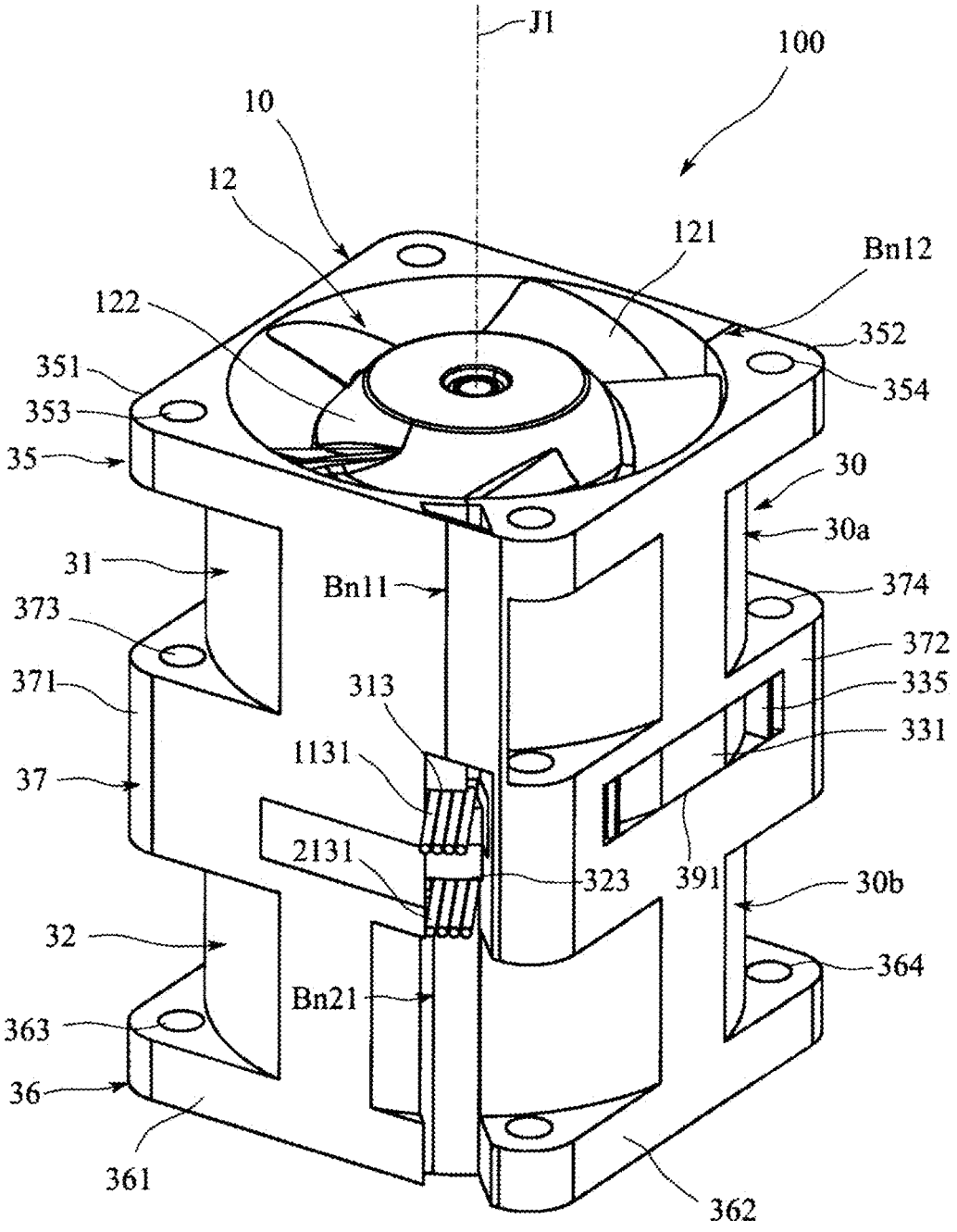
FIG. 1 is a perspective view of a blower according to an example embodiment of the present disclosure.
Figure 2:
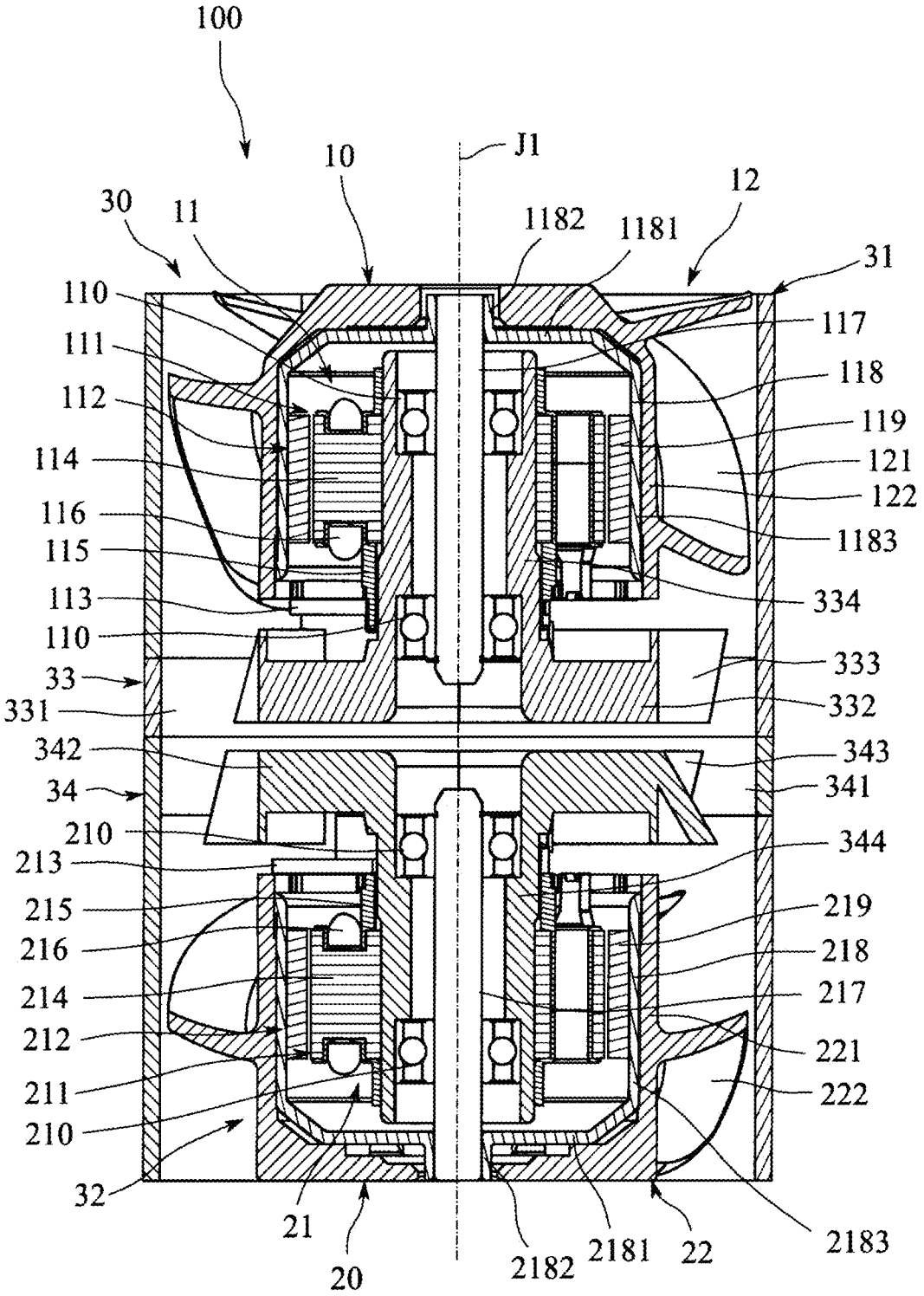
FIG. 2 is a longitudinal sectional view of the blower of FIG. 1 taken along a plane including a central axis of the blower.
Figure 3:
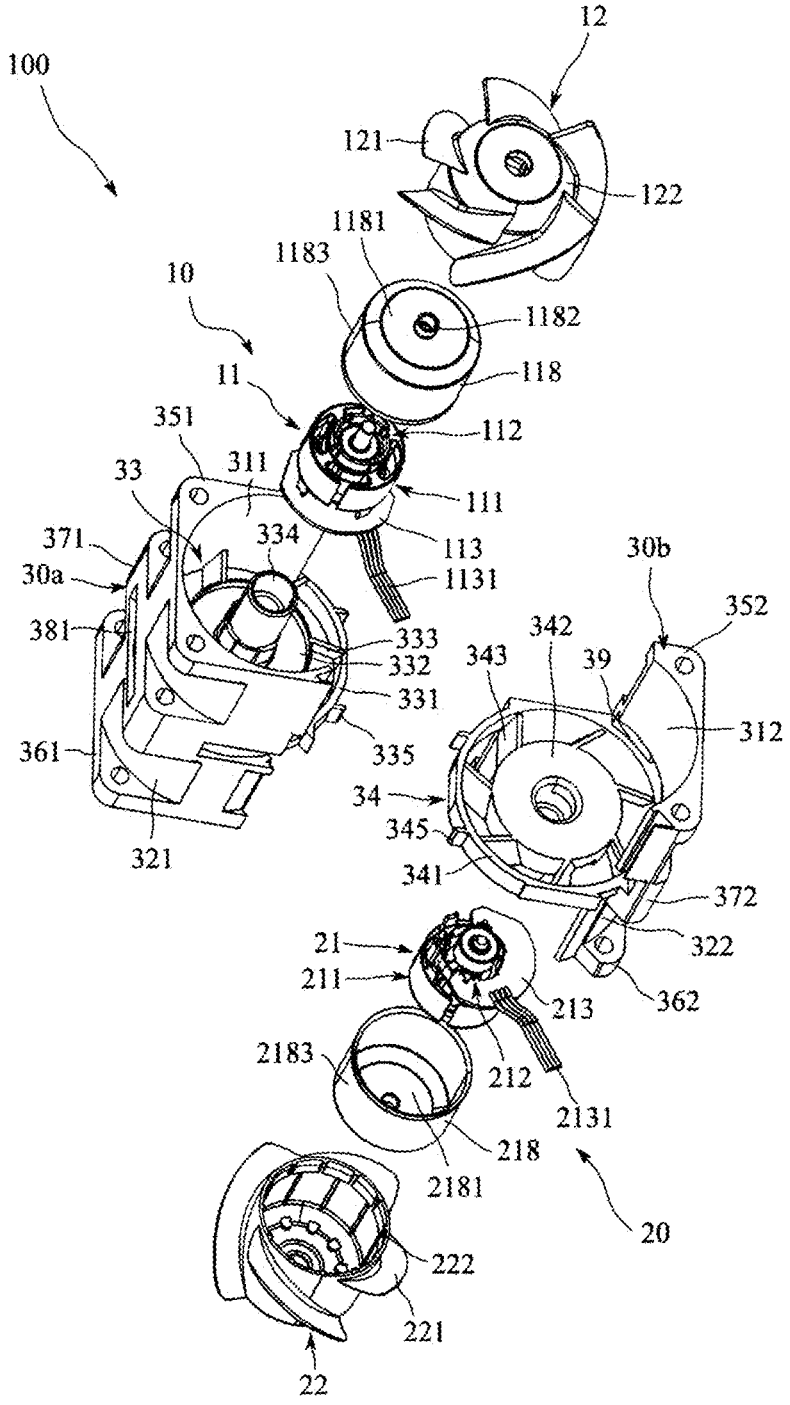
FIG. 3 is an exploded perspective view of the blower.
Figure 4:
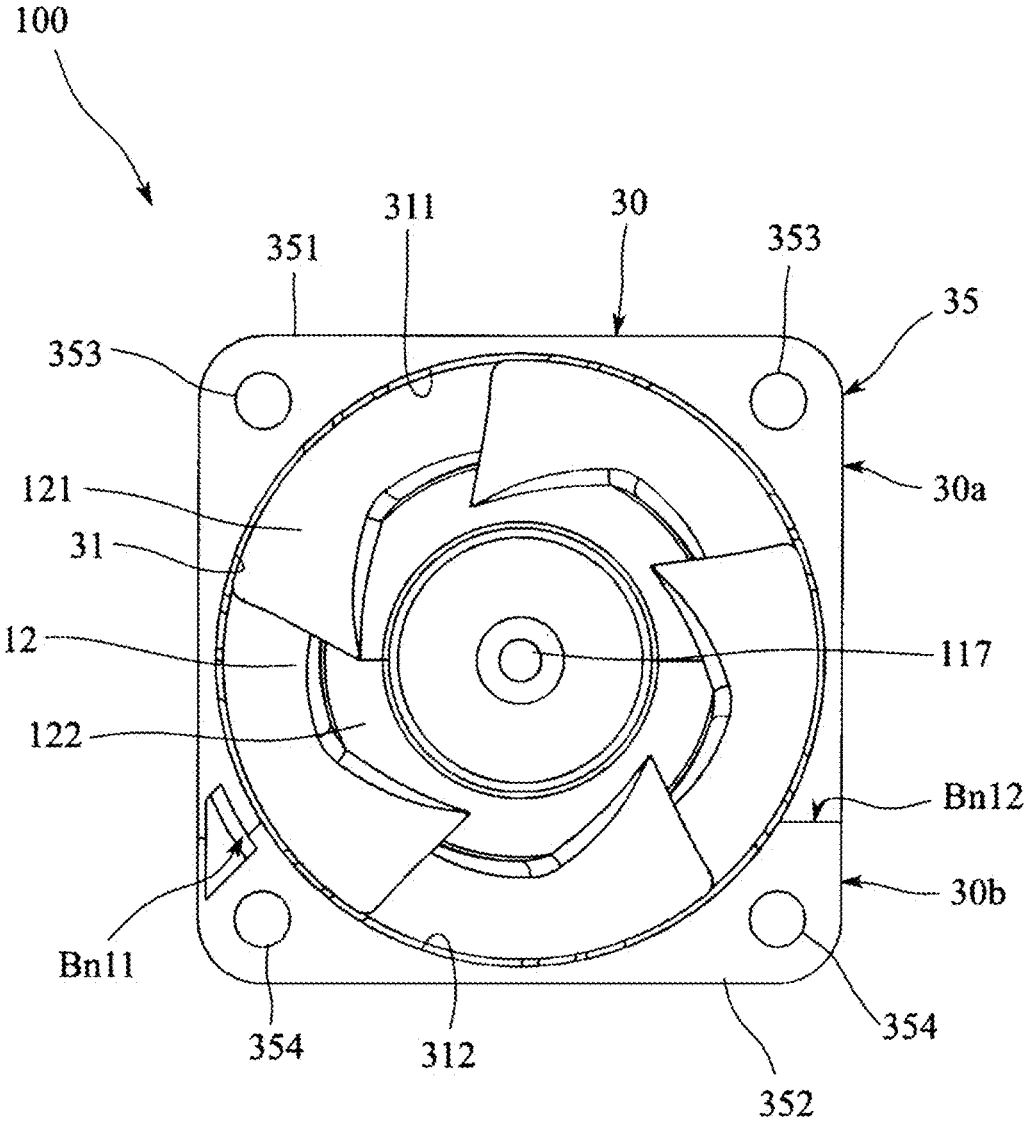
FIG. 4 is a plan view of the blower.
Figure 5:
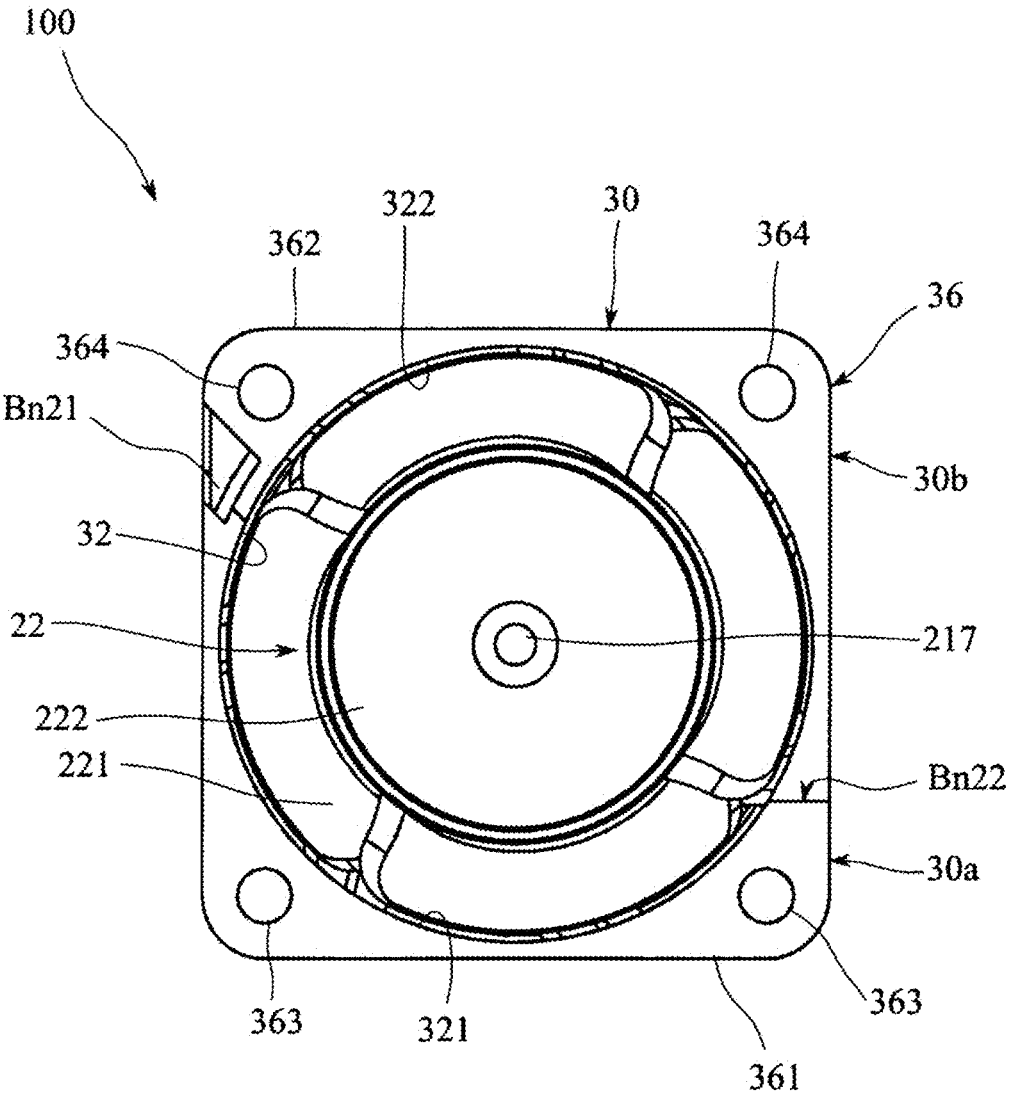
FIG. 5 is a bottom view of the blower.
Figure 6:
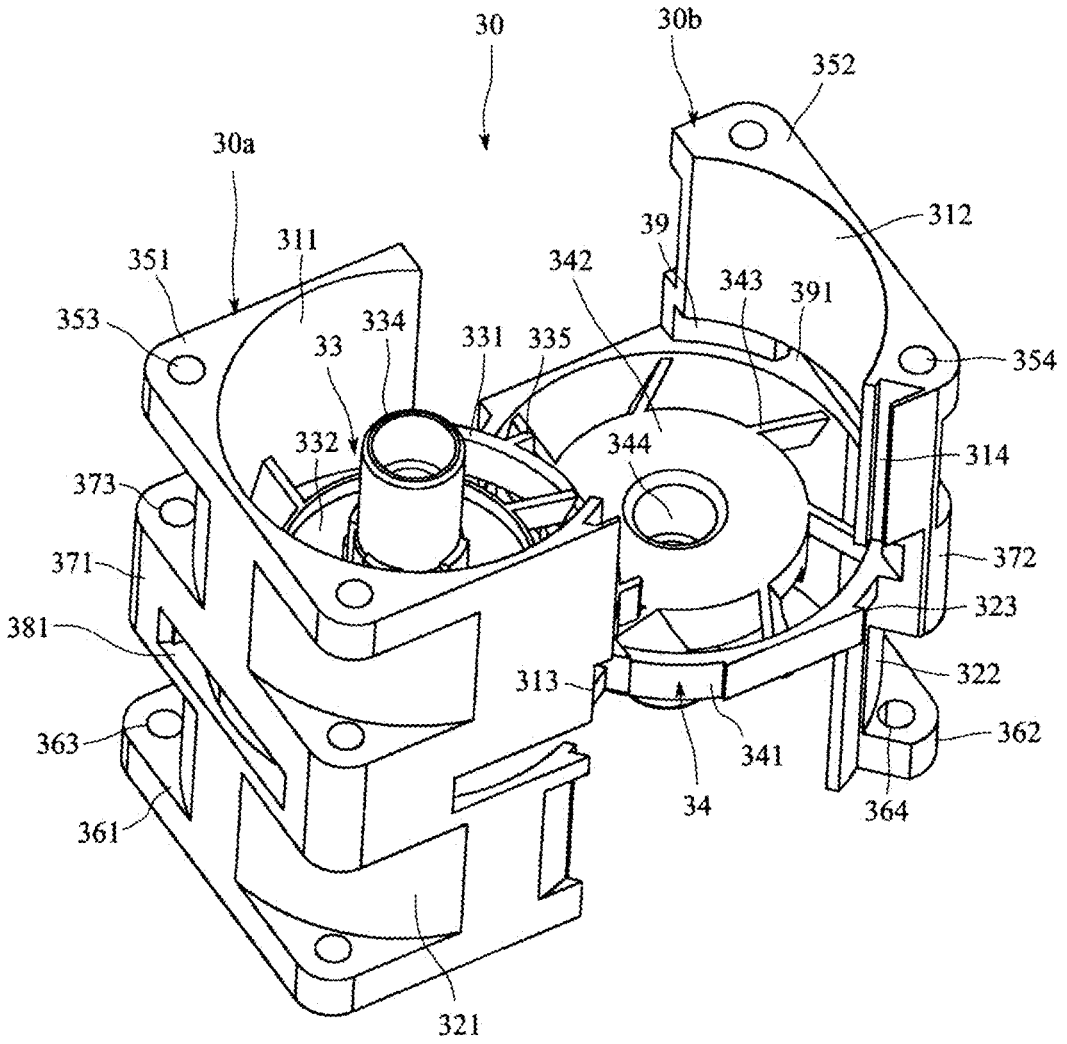
FIG. 6 is an exploded perspective view of a disassembled housing as viewed from above.
Figure 7:
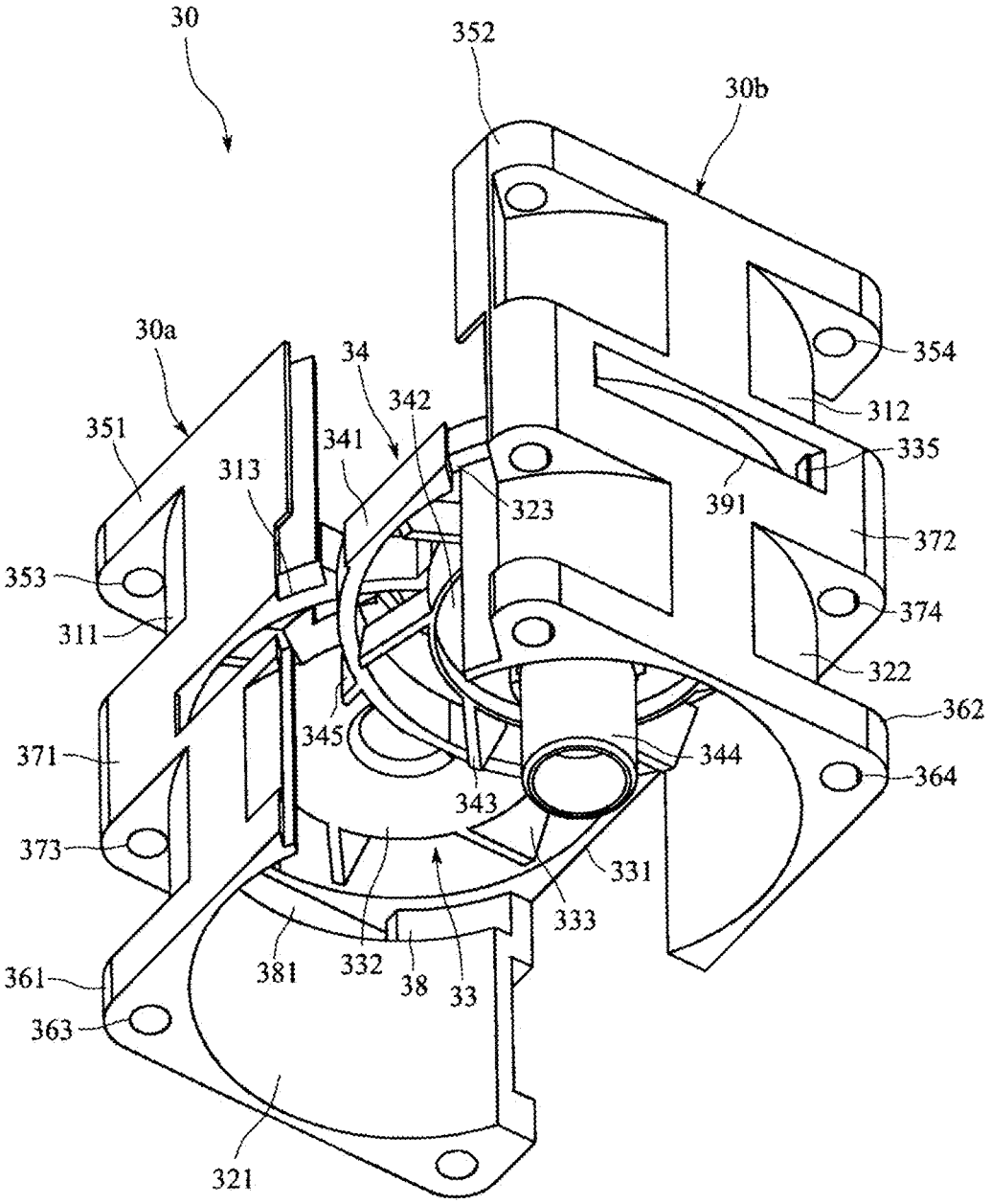
FIG. 7 is an exploded perspective view of the disassembled housing as viewed from below.

Hereinafter, a blower according to an example embodiment of the present disclosure will be described. FIG. 1 is a perspective view of an example of a blower 100 according to the present disclosure. FIG. 2 is a longitudinal sectional view of the blower 100 taken along a plane including a central axis J1 of the blower 100. FIG. 3 is an exploded perspective view of the blower 100. FIG. 4 is a plan view of the blower 100. FIG. 5 is a bottom view of the blower 100. FIG. 6 is an exploded perspective view of a disassembled housing 30 as viewed from above. FIG. 7 is an exploded perspective view of the disassembled housing 30 as viewed from below.

The blower 100 sucks air from an opening (intake port) provided at its axially upper end portion. Then, the sucked air is accelerated (compressed) inside the blower 100, and is discharged from an opening (discharge port) provided at an axially lower end portion of the blower 100.

As illustrated in FIGS. 1 to 5, the blower 100 includes a first fan unit 10, a second fan unit 20, and a housing 30. The first fan unit 10 and the second fan unit 20 are disposed side by side vertically. The first fan unit 10 is disposed above the second fan unit 20. The first fan unit 10 and the second fan unit 20 are disposed inside the housing 30.

The first fan unit 10 is disposed on an intake side of the second fan unit 20. In the blower 100, the first fan unit 10 and the second fan unit 20 are connected in series along the central axis J1. The first fan unit 10 and the second fan unit 20 each have the center aligned with the central axis J1.

The first fan unit 10 accelerates (pressurizes) air sucked from the intake port and causes the air to flow into the second fan unit 20. The second fan unit 20 accelerates (pressurizes) the air flowing from the first fan unit 10 and blows out the air from the discharge port. The first fan unit 10 and the second fan unit 20 each may have its main purpose of increasing an air volume (acceleration) or increasing pressure (pressurization) by changing shapes of a first impeller 12 and a second impeller 22 described later. Each of the first fan unit 10 and the second fan unit 20 may have a main purpose of increasing an air volume or increasing pressure, or one of them may have a main purpose of increasing wind power and the other may have a main purpose of increasing pressure.

As illustrated in FIG. 1, the housing 30 is a tubular body extending along the central axis J1, and houses the first fan unit 10 and the second fan unit 20 therein. That is, the blower 100 extends along the central axis J1 and includes the housing 30 in a tubular shape, accommodating the first fan unit 10 and the second fan unit 20.

The housing 30 is divided into a first member 30*a* and a second member 30*b*. The first member 30*a* and the second member 30*b* are each a resin molding. They are each not limited to a resin molding, and each may be a metal molding. They each may be formed of a combination of resin and metal. In the case of a combination of resin and metal, for example, they may be formed by insert molding, or may be fixed to each other using a fixing method such as press fitting.

The housing 30 includes an upper tubular portion 31, a lower tubular portion 32, a first fan support 33, a second fan support 34, an upper flange 35, a lower flange 36, and a central flange 37. Providing the upper flange 35, the lower flange 36, and the central flange 37, increases strength of the housing 30.

The upper tubular portion 31 and the lower tubular portion 32 are disposed side by side vertically in the axial direction. The upper tubular portion 31 and the lower tubular portion 32 each have the center aligned with the central axis J1. The first fan unit 10 is accommodated inside the upper tubular portion 31. The second fan unit 20 is accommodated inside the lower tubular portion 32. That is, the housing 30 includes the upper tubular portion 31 accommodating the first fan unit 10, and the lower tubular portion 32 accommodating the second fan unit 20.

The first fan unit 10 and the second fan unit 20 each rotate about the central axis J1 to generate an airflow flowing downward from above in the axial direction. That is, the first fan unit 10 generates an airflow flowing in a direction along the central axis J1 extending vertically. The second fan unit 20 is disposed below the first fan unit 10 in the axial direction, and is disposed coaxially with the first fan unit 10.

The upper tubular portion 31 has a cylindrical shape and is separable in the circumferential direction. One of divided upper tubular portions 31 is a first upper tubular divided body 311 and the other is a second upper tubular divided body 312. The first upper tubular divided body 311 is included in the first member 30*a*. The second upper tubular divided body 312 is included in the second member 30*b*. The upper tubular portion 31 is divided at two places in the circumferential direction. One of the two places is indicated as a first parting portion Bn11, and the other is indicated as a second parting portion Bn12.

The first fan support 33 is disposed at an axially lower end portion inside the upper tubular portion 31. The first fan support 33 supports the first fan unit 10 (see FIG. 2). The first fan support 33 includes a first support frame 331, a first base 332, a first rib 333, a first bearing holder 334, and a first protrusion 335.

The first support frame 331 has an arch shape obtained by cutting a cylinder about the central axis J1 in the circumferential direction. The first support frame 331 has opposite circumferential ends that are connected to respective circumferential ends of a lower end portion of the first upper tubular divided body 311. That is, the first support frame 331 has an arch shape obtained by cutting a tubular body about the central axis J1 in the circumferential direction, and couples opposite circumferential ends of an axially lower end portion of the first upper tubular divided body 311.

The first upper tubular divided body 311 has a radially inner surface that is smoothly continuous with a radially inner surface of the first support frame 331. The term, "smoothly continuous", indicates a connection maintaining differentiability, i.e., a connection in a state where a sharpened portion cannot be formed. More specifically, a curved surface connecting the radially inner surface of the first upper tubular divided body 311 and the radially inner surface of the first support frame 331 has a cylindrical shape about the central axis J1.

The first support frame 331 is partly inserted into a second holder 39 described below formed on a radially inner surface of the second member 30*b*. Then, when the first support frame 331 is inserted into the second holder 39, the radially inner surface of the first support frame 331 is smoothly continuous with the radially inner surface of the second member 30*b*. This allows an airflow to be less likely to be disturbed at a connection between the radially inner surface of the first support frame 331 and the radially inner surface of the second member 30*b*.

The first support frame 331 is provided on its radially outer surface with a first protrusion 335. The first protrusion 335 protrudes radially outward from the radially outer surface of the first support frame 331. The first protrusion 335 extends in a direction that is, for example, an insertion direction in which the first support frame 331 is inserted into the second holder 39. Then, the first protrusion 335 is inserted into a second through portion 391 provided in the second holder 39.

The first protrusion 335 may be formed in a snap-fit shape provided at its leading end with a stopper in the shape of a wedge increasing in circumferential width radially inward, the stopper being provided at an axially outer end of the first protrusion 335. Forming the first protrusion 335 into a snap-fit shape allows the first protrusion 335 to be less likely to come off after being inserted into the second through portion 391. This causes the first member 30*a* to be less likely to be separated from the second member 30*b*.

The first base 332 is disposed at a lower end inside the upper tubular portion 31. The first fan unit 10 is attached to the first base 332. The first base 332 has a radially outer surface that radially faces the radially inner surface of the first upper tubular divided body 311 and the radially inner surface of the first support frame 331 at intervals. A gap between the radially outer surface of the first base 332 and the radially inner surface of the first upper tubular divided body 311 as well as the radially inner surface of the first support frame 331 constitutes a part of a flow path in which an airflow generated by rotation of the first fan unit 10 flows.

A plurality of first ribs 333 is provided. The plurality of first ribs 333 couples the radially outer surface of the first base 332 to the radially inner surface of the first upper tubular divided body 311 and the radially inner surface of the first support frame 331. That is, the first ribs 333 radially couple the first base 332 to the first support frame 331. More specifically, the first base 332 is supported by the first ribs 333. The plurality of first ribs 333 is disposed at equal intervals in the circumferential direction. The first ribs 333 are disposed in the flow path of an airflow, and each may be in the shape of a stationary blade that is inclined in the circumferential direction and straightens an airflow.

The first base 332 has a center aligned with the central axis J1. Then, the first base 332 has an upper surface orthogonal to the central axis J1. The first bearing holder 334 extends upward in the axial direction from a radially central portion of the upper surface of the first base 332. The first bearing holder 334 has a tubular shape with the center aligned with the central axis J1. Inside the first bearing holder 334, two first bearings 110 of a first motor 11 of the first fan unit 10 are disposed at an interval in the axial direction.

The two first bearings 110 are each a ball bearing, and an outer ring of each of the first bearings 110 is fixed to an inner peripheral surface of the first bearing holder 334. The first bearings 110 each include an inner ring and the outer ring whose centers are aligned with the central axis J1. Then, a first shaft 117 described later is fixed to the inner ring. The first shaft 117 is rotatably supported inside the first bearing holder 334 by the first bearings 110. The first shaft 117 has a center aligned with the central axis J1, and the first shaft 117 is rotatably supported about the central axis J1.

While the first shaft 117 is supported by the two first bearings 110 in the blower 100 of the present example embodiment, it is not limited to this. The first shaft 117 may be supported by two or more first bearings 110. While each of the first bearings 110 is a ball bearing in the present example embodiment, it is not limited to this. For example, a fluid bearing or the like may be available. There are widely available bearings capable of allowing the center of the first shaft 117 to be aligned with the central axis J1 and rotatably supporting the first shaft 117 about the central axis J1. While the two first bearings 110 are ball bearings in the present example embodiment, they are not limited to this. For example, one fluid bearing or the like may be available.

The first bearing holder 334 has an outer peripheral surface to which a first stator core 114 described later of the first stator 111 is attached. The first stator core 114 is fixed to the first bearing holder 334 by press-fitting the first bearing holder 334 into a core back of the first stator core 114. The fixing between the first stator core 114 and the first bearing holder 334 is not limited to press-fitting. For example, the fixing can be performed by bonding, welding, screwing, or the like.

The first fan unit 10 includes the first motor 11 and the first impeller 12.

The first motor 11 is a brushless DC motor of an outer rotor type. The first motor 11 rotates the first impeller 12. As illustrated in FIG. 2 and the like, the first motor 11 includes a first stator 111, a first rotor 112, and a first circuit board 113.

The first stator 111 includes a first stator core 114, a first insulator 115, and a first coil 116. The first stator core 114 is a layered body in which electromagnetic steel sheets are layered in the axial direction. The first stator core 114 is not limited to a layered body in which electromagnetic steel sheets are layered, and may be a single member, such as a fired body of powder or a casting, for example.

The first stator core 114 includes a core back in an annular shape and a plurality of (three, herein) teeth. The three teeth extend radially outward from an outer peripheral surface of the core back and are formed radially. This causes the three teeth to be disposed in the circumferential direction. The plurality of teeth is disposed at equal intervals in the circumferential direction.

As described above, the first stator core 114 is fixed to the first bearing holder 334 of the housing 30. The first stator core 114 is fixed to the first bearing holder 334 by press-fitting the first bearing holder 334 into the core back of the first stator core 114. A method for fixing the core back to the first bearing holder 334 is not limited to press-fitting, and another method such as bonding may be available. When the first stator core 114 is attached to the first bearing holder 334, the first stator core 114 has a center aligned with the central axis J1.

The first stator core 114 is partly covered with the first insulator 115. The first insulator 115 is, for example, a molding of a resin having insulating properties. The first coil 116 is formed by winding a conductive wire around each tooth of the first stator core 114 to which the first insulator 115 is attached. The first insulator 115 insulates the first stator core 114 from the first coil 116.

The first rotor 112 includes a first shaft 117, a first rotor yoke 118, and a first rotor magnet 119. The first shaft 117 is made of metal and has a columnar shape. The first shaft 117 is not limited to metal. The first shaft 117 may have a cylindrical shape having a space inside.

As illustrated in FIG. 2, the first rotor yoke 118 includes a rotor lid portion 1181, a shaft fixing portion 1182, and a rotor tubular portion 1183. The rotor lid portion 1181 is provided at its radial center with a through-hole radially passing through the rotor lid portion 1181, and has an annular shape extending radially. The shaft fixing portion 1182 has a tubular shape extending axially upward from an edge of the through hole of the rotor lid portion 1181. The shaft fixing portion 1182 may be configured to extend axially downward from the edge of the through hole of the rotor lid portion 1181. The rotor tubular portion 1183 is a tubular body that extends axially downward from a radially outer edge of the rotor lid portion 1181.

As illustrated in FIG. 2, the first shaft 117 supported by the first bearing holder 334 using the first bearings 110 has an upper end located above an upper end of the first bearing holder 334. The shaft fixing portion 1182 of the first rotor yoke 118 is fixed to the upper end of the first shaft 117. While examples of a method for fixing the first shaft 117 to the shaft fixing portion 1182 include press-fitting, the method is not limited to press-fitting, and other methods such as bonding may be available.

The first rotor magnet 119 is in a cylindrical shape. The first rotor magnet 119 is fixed to an inner peripheral surface of the rotor tubular portion 1183 of the first rotor yoke 118. The first rotor magnet 119 is magnetized to the N-pole and the S-pole alternately in the circumferential direction. In place of the first rotor magnet 119 in a cylindrical shape, a plurality of field magnets may be disposed in the circumferential direction.

As described above, the first motor 11 includes the first stator core 114 of the first stator 111 that is fixed to an outer peripheral surface of the first bearing holder 334. The first shaft 117 of the first rotor 112 is rotatably supported inside the first bearing holder 334 by the first bearings 110. The first rotor yoke 118 fixed with the first rotor magnet 119 is attached to the first shaft 117, and the first rotor magnet 119 of the first rotor 112 is disposed radially outside the first stator 111.

That is, the first rotor magnet 119 of the first rotor 112 has a radially inner surface that faces a radially outer surface of the teeth of the first stator core 114 with a radial gap. When a current is supplied to the first coil 116 in this state, the first coil 116 is excited, and the first rotor 112 is rotated by magnetic force between the first coil 116 and the first rotor magnet 119.

The first circuit board 113 is disposed below the first stator 111 and above the first base 332 in the axial direction along the central axis J1. The first circuit board 113 is held by, for example, the first insulator 115. Alternatively, the first circuit board 113 may be fixed to the first base 332. At this time, the first circuit board 113 may be pressed by the first insulator 115. The first circuit board 113 is connected to a conducting wire of the first coil 116. Then, a current is supplied to the first coil 116 via the first circuit board 113. That is, the first fan unit 10 includes the first motor 11, the first impeller 12, and the first circuit board 113 that supplies electric power to the first motor 11.

The first circuit board 113 is connected to a first conductive wire 1131 that is connected to the outside. The first conductive wire 1131 is drawn out of the upper tubular portion 31 through a first conductive wire drawing portion 313 formed in the first parting portion Bn11 of the upper tubular portion 31.

The first impeller 12 includes a plurality of blades 121 and a cup 122. The cup 122 has a lidded cylindrical shape. The cup 122 is fixed to the rotor lid portion 1181 of the first rotor yoke 118 and an outer surface of the rotor tubular portion 1183. While the tubular portion is fixed to the first rotor yoke 118 by a method of bonding, for example, the method is not limited to this.

The plurality of blades 121 protrudes radially outward from an outer peripheral surface of the cup 122. The plurality of blades 121 is disposed at equal intervals in the circumferential direction. The blades 121 are each inclined in the circumferential direction. Rotating the first impeller 12 generates an airflow flowing downward from above in the axial direction. In other words, the blades 121 are each inclined in a direction allowing an airflow downward from above to be generated when the first impeller 12 is rotated in a predetermined direction.

The first fan unit 10 is disposed inside the upper tubular portion 31 with the first impeller 12 attached to the first rotor yoke 118. That is, the first motor 11 and the first impeller 12 are accommodated inside the upper tubular portion 31.

At this time, the blades 121 each have a radially outer edge that radially faces an inner peripheral surface of the upper tubular portion 31 with a gap. Thus, when the first impeller 12 is rotated, the blades 121 come into no contact with the inner peripheral surface of the upper tubular portion 31. In addition, the inner peripheral surface of the upper tubular portion 31 faces the radially outer edge of each of the blades 121 with a gap therebetween, so that an airflow flowing radially outward flows axially downward with rotation of the first impeller 12. That is, when the first impeller 12 is rotated, the upper tubular portion 31 serves as a wind tunnel. In addition, when the first upper tubular divided body 311 is smoothly continuous with the second upper tubular divided body 312, turbulence of the airflow at a connection therebetween is reduced.

As illustrated in FIG. 1 and the like, the upper flange 35 extends radially outward from an axially upper end portion of an outer peripheral surface of the upper tubular portion 31. That is, the housing 30 includes the upper flange 35 that extends radially outward from an outer peripheral surface of the axially upper end portion of the upper tubular portion 31. The upper flange 35 has a square shape when viewed from the axial direction (see FIG. 4). The upper flange 35 includes a first upper flange 351, a second upper flange 352, two (plural) first upper mounting holes 353, and two (plural) second upper mounting holes 354.

The upper flange 35 is disassembled into the first upper flange 351 and the second upper flange 352. The first upper flange 351 is included in the first member 30*a*, and the second upper flange 352 is included in the second member 30*b*. That is, the upper flange 35 is divided into the first upper flange 351 included in the first member 30*a* and the second upper flange 352 included in the second member 30*b*.

When the upper flange 35 is viewed in the axial direction, the first upper flange 351 and the second upper flange 352 each have an opposite side. Then, a parting portion is provided in each side other than the opposite side. The upper flange 35 is divided at two places in the circumferential direction that are each located closer to the opposite side of the second upper flange 352 of the two opposite sides of the first upper flange 351 and the second upper flange 352.

The upper flange 35 includes the two first upper mounting holes 353 and the two second upper mounting holes 354. The two first upper mounting holes 353 are disposed radially outside the upper tubular portion 31 of the upper flange 35. The second upper mounting holes 354 are also disposed radially outside the upper tubular portion 31 of the upper flange 35. The two first upper mounting holes 353 are disposed in the first upper flange 351. The two second upper mounting holes 354 are disposed in the second upper flange 352.

Into each of the first upper mounting holes 353 and the second upper mounting holes 354, a fixture (not illustrated) such as a bolt is inserted. When bolts are screwed into respective female screws (not illustrated) provided in an external device (not illustrated) with the blower 100 to be attached, the blower 100 is fixed to the external device. The fixture is not limited to a bolt, and there are widely available structures capable of passing through each mounting hole and firmly fixing the blower 100 to an external device. That is, the first upper flange 351 includes the plurality of first upper mounting holes 353 each for attaching a fixture, and the second upper flange 352 includes the plurality of second upper mounting holes 354 each for attaching a fixture.

The first member 30*a* has an inner peripheral surface including a radially inner surface of a first lower tubular divided body 321, the radially inner surface being provided at its upper end with a first holder 38 recessed radially outward. Into the first holder 38, a second support frame 341 of the second member 30*b*, described later, is inserted. That is, the first member 30*a* includes the first holder 38 that is formed at the upper end of the radially inner surface of the first lower tubular divided body 321 and that is recessed radially outward to accommodate a part of the second support frame 341.

The first holder 38 is formed with a first through portion 381 that passes through the first holder 38 in the radial direction. Into the first through portion 381, a second protrusion 345 provided on a radially outer surface of the second support frame 341 is inserted. That is, the first holder 38 includes the through portion 381 passing through the first holder 38 in the radial direction, and the radially outer surface of the second support frame 341 includes the second protrusion 345 that is insertable into the through portion 381. When the second support frame 341 is inserted into the first holder 38, the second member 30*b* can be axially positioned with respect to the first member 30*a*. Additionally, the first member 30*a* can be firmly combined with the second member 30*b*. When the second protrusion 345 is inserted into the first through portion 381, circumferential displacement can be reduced.

The lower tubular portion 32 is in a cylindrical shape like the upper tubular portion 31, and is separable in the circumferential direction. One of divided lower tubular portions 32 is the first lower tubular divided body 321, and the other is a second lower tubular divided body 322. The first lower tubular divided body 321 is included in the first member 30*a*. The second lower tubular divided body 322 is included in the second member 30*b*. The upper tubular portion 31 is smoothly continuous with the lower tubular portion 32. This causes an airflow to be less likely to be disturbed when the airflow flows from the upper tubular portion 31 to the lower tubular portion 32. The lower tubular portion 32 is divided at two places in the circumferential direction. One of the two places is indicated as a third parting portion Bn21, and the other is indicated as a fourth parting portion Bn22.

The second fan support 34 is disposed at an axially lower end portion inside the lower tubular portion 32. The second fan support 34 supports the second fan unit 20. The second fan support 34 includes the second support frame 341, a second base 342, a second rib 343, a second bearing holder 344, and the second protrusion 345.

The second support frame 341 has an arch shape obtained by cutting a cylinder about the central axis J1 in the circumferential direction. The second support frame 341 has opposite circumferential ends that are connected to respective circumferential ends of an upper end portion of the second lower tubular divided body 322. That is, the second support frame 341 has an arch shape obtained by cutting a tubular body about the central axis J1 in the circumferential direction, and couples opposite circumferential ends of an axially upper end portion of the second lower tubular divided body 322.

The second lower tubular divided body 322 has a radially inner surface that is smoothly continuous with a radially inner surface of the second support frame 341. More specifically, a curved surface connecting the radially inner surface of the second lower tubular divided body 322 and the radially inner surface of the second support frame 341 has a cylindrical shape about the central axis J1.

The second support frame 341 is partly inserted into the first holder 38 formed on a radially inner surface of the first member 30*a*. Then, when the second support frame 341 is inserted into the first holder 38, the radially inner surface of the second support frame 341 is smoothly continuous with the radially inner surface of the first member 30*a*. This allows an airflow to be less likely to be disturbed at a connection between the radially inner surface of the second support frame 341 and the radially inner surface of the first member 30*a*.

The second support frame 341 is provided on its radially outer surface with the second protrusion 345. The second protrusion 345 protrudes radially outward from the radially outer surface of the second support frame 341. The second protrusion 345 335 extends in a direction that is, for example, an insertion direction in which the second support frame 341 is inserted into the first holder 38. Then, the second protrusion 345 is inserted into the first through portion 381 provided in the first holder 38.

The second protrusion 345 may be formed in a snap-fit shape provided at its leading end with a stopper in the shape of a wedge increasing in circumferential width radially inward, the stopper being provided at a radially outer end of the second protrusion 345. Forming the second protrusion 345 into a snap-fit shape allows the second protrusion 345 to be less likely to come off after being inserted into the first through portion 381. This causes the second member 30*b* to be less likely to be separated from the first member 30*a*.

The second base 342 is disposed at an upper end inside the lower tubular portion 32. The second fan unit 20 is attached to the second base 342. The second base 342 has a radially outer surface that radially faces the radially inner surface of the first lower tubular divided body 321 and the radially inner surface of the second support frame 341 at intervals. A gap between the radially outer surface of the second base 342 and the radially inner surface of first lower tubular divided body 321 as well as the radially inner surface of the second support frame 341 constitutes a part of a flow path in which an airflow generated by rotation of the second fan unit 20 flows.

A plurality of second ribs 343 is provided. The plurality of second ribs 343 couples the radially outer surface of the second base 342 to the radially inner surface of the first lower tubular divided body 321 and the radially inner surface of the second support frame 341. That is, the second ribs 343 radially couple the second base 342 to the second support frame 341. More specifically, the second base 342 is supported by the second ribs 343. The plurality of second ribs 343 is disposed at equal intervals in the circumferential direction. The second ribs 343 are disposed in the flow path of an airflow, and each may be in the shape of a stationary blade that is inclined in the circumferential direction and straightens an airflow.

The second base 342 has a center aligned with the central axis J1. Then, the second base 342 has an upper surface orthogonal to the central axis J1. The second bearing holder 344 extends downward in the axial direction from a radially central portion of a lower surface of the second base 342. The second bearing holder 344 has a tubular shape with the center aligned with the central axis J1. Inside the second bearing holder 344, two second bearings 210 are disposed at intervals in the axial direction.

The two second bearings 210 are each a ball bearing, and an outer ring of each of the second bearings 210 is fixed to an inner peripheral surface of the second bearing holder 344. The second bearings 210 each include an inner ring and the outer ring whose centers are aligned with the central axis J1. Then, the inner ring is fixed to a second shaft 217. This allows the second shaft 217 to be rotatably supported inside the second bearing holder 344 by the second bearings 210. The second shaft 217 has a center aligned with the central axis J1, and the second shaft 217 is rotatably supported about the central axis J1.

While the second shaft 217 is supported by the two second bearings 210 in the blower 100 of the present example embodiment, it is not limited to this. The second shaft 217 may be supported by two or more second bearings 210. While each of the second bearings 210 is a ball bearing in the present example embodiment, it is not limited to this. For example, a fluid bearing or the like may be available. There are widely available bearings capable of allowing the center of the second shaft 217 to be aligned with the central axis J1 and rotatably supporting the second shaft 217 about the central axis J1.

The second bearing holder 344 has an outer peripheral surface to which a second stator core 214 of the second stator 211 is attached. The second stator core 214 is fixed to the second bearing holder 344 by press-fitting the second bearing holder 344 into a core back of the second stator core 214. The fixing between the second stator core 214 and the second bearing holder 344 is not limited to press-fitting. For example, the fixing can be performed by bonding, welding, screwing, or the like.

The second protrusion 345 is provided on the radially outer surface of the second support frame 341 and protrudes radially outward from the radially outer surface. The second protrusion 345 is inserted into the first through portion 381 of the first holder 38 provided in the first member 30*a*.

The second fan unit 20 includes a second motor 21 and a second impeller 22.

The second motor 21 is a brushless DC motor of an outer rotor type. The second motor 21 rotates the second impeller 22. As illustrated in FIG. 2 and the like, the second motor 21 includes a second stator 211, a second rotor 212, and a second circuit board 213.

The second stator 211 includes a second stator core 214, a second insulator 215, and a second coil 216. The second stator core 214 is a layered body in which electromagnetic steel sheets are layered in the axial direction. The second stator core 214 is not limited to a layered body in which electromagnetic steel sheets are layered, and may be a single member, such as a fired body of powder or a casting, for example.

The second stator core 214 includes a core back in an annular shape and a plurality of (three, herein) teeth. The three teeth extend radially outward from an outer peripheral surface of the core back and are formed radially. This causes the three teeth to be disposed in the circumferential direction. The plurality of teeth is disposed at equal intervals in the circumferential direction.

As described above, the second stator core 214 is fixed to the second bearing holder 344 of the housing 30. The second stator core 214 is fixed to the second bearing holder 344 by press-fitting the second bearing holder 344 into the core back of the second stator core 214. A method for fixing the core back to the second bearing holder 344 is not limited to press-fitting, and another method such as bonding may be available. When the second stator core 214 is attached to the second bearing holder 344, the second stator core 214 has a center aligned with the central axis J1.

The second stator core 214 is partly covered with the second insulator 215. The second insulator 215 is, for example, a molding of a resin having insulating properties. The second coil 216 is formed by winding a conductive wire around each tooth of the second stator core 214 to which the second insulator 215 is attached. The second insulator 215 insulates the second stator core 214 from the second coil 216.

The second rotor 212 includes a second shaft 217, a second rotor yoke 218, and a second rotor magnet 219. The second shaft 217 is made of metal and has a columnar shape. The second shaft 217 is not limited to metal. The first shaft 117 may have a cylindrical shape having a space inside.

As illustrated in FIG. 2, the second rotor yoke 218 includes a rotor lid portion 2181, a shaft fixing portion 2182, and a rotor tubular portion 2183. The rotor lid portion 2181 is provided at its radial center with a through-hole radially passing through the rotor lid portion 2181, and has an annular shape extending radially. The shaft fixing portion 2182 has a tubular shape extending axially upward from an edge of the through hole of the rotor lid portion 2181. The shaft fixing portion 2182 may be configured to extend axially downward from the edge of the through hole of the rotor lid portion 2181. The rotor tubular portion 2183 is a tubular body that extends axially downward from a radially outer edge of the rotor lid portion 2181.

As illustrated in FIG. 2, the second shaft 217 supported by the second bearing holder 344 using the second bearings 210 has an upper end located above an upper end of the second bearing holder 344. The shaft fixing portion 2182 of the second rotor yoke 218 is fixed to the upper end of the second shaft 217. While examples of a method for fixing the second shaft 217 to the shaft fixing portion 2182 include press-fitting, the method is not limited to press-fitting, and other methods such as bonding may be available.

The second rotor magnet 219 is in a cylindrical shape. The second rotor magnet 219 is fixed to an inner peripheral surface of the rotor tubular portion 2183 of the second rotor yoke 218. The second rotor magnet 219 is magnetized to the N-pole and the S-pole alternately in the circumferential direction. In place of the second rotor magnet 219 in a cylindrical shape, a plurality of field magnets may be disposed in the circumferential direction.

As described above, the second motor 21 includes the second stator core 214 of the second stator 211 that is fixed to an outer peripheral surface of the second bearing holder 344. The second shaft 217 of the second rotor 212 is rotatably supported inside the second bearing holder 344 by the second bearings 210. The second rotor yoke 218 fixed with the second rotor magnet 219 is attached to the second shaft 217, and the second rotor magnet 219 of the second rotor 212 is disposed radially outside the second stator 211.

That is, the second rotor magnet 219 of the second rotor 212 has a radially inner surface that faces a radially outer surface of the teeth of the second stator core 214 with a radial gap. When a current is supplied to the second coil 216 in this state, the second coil 216 is excited, and the second rotor 212 is rotated by a magnetic force between the second coil 216 and the second rotor magnet 219.

The second circuit board 213 is disposed above the second stator 211 and below the second base 342 in the axial direction along the central axis J1. The second circuit board 213 is held by, for example, the second insulator 215. Alternatively, the second circuit board 213 may be fixed to the second base 342. At this time, the second circuit board 213 may be pressed by the second insulator 215. The second circuit board 213 is connected to a conducting wire of the second coil 216. Then, a current is supplied to the second coil 216 via the second circuit board 213. That is, the second fan unit 20 includes the second motor 21, the second impeller 22, and the second circuit board 213 that supplies electric power to the second motor 21.

The second impeller 22 includes a plurality of blades 221 and a cup 222. The cup 222 has a lidded cylindrical shape. The cup 222 is fixed to the rotor lid portion 2181 of the second rotor yoke 218 and an outer surface of the rotor tubular portion 2183. While the cup 222 is fixed to the second rotor yoke 218 by a method of bonding, for example, the method is not limited to this.

The plurality of blades 221 protrudes radially outward from an outer peripheral surface of the cup 222. The plurality of blades 221 is disposed at equal intervals in the circumferential direction. The blades 221 are each inclined in the circumferential direction. Rotating the second impeller 22 generates an airflow flowing downward from above in the axial direction. In other words, the blades 221 are each inclined in a direction allowing an airflow downward from above to be generated when the second impeller 22 is rotated in a predetermined direction.

The second fan unit 20 is disposed inside the lower tubular portion 32 with the second impeller 22 attached to the second rotor yoke 218. That is, the second motor 21 and the second impeller 22 are accommodated inside the lower tubular portion 32.

At this time, the blades 221 each have a radially outer edge that radially faces an inner peripheral surface of the lower tubular portion 32 with a gap. Thus, when the second impeller 22 is rotated, the blades 221 come into no contact with the inner peripheral surface of the lower tubular portion 32. In addition, the inner peripheral surface of the lower tubular portion 32 faces the radially outer edge of each of the blades 221 with a gap therebetween, so that an airflow flowing radially outward flows axially downward with rotation of the second impeller 22. That is, when the second impeller 22 is rotated, the lower tubular portion 32 serves as a wind tunnel. In addition, when the first lower tubular divided body 321 is smoothly continuous with the second lower tubular divided body 322, turbulence of the airflow at a connection therebetween is reduced.

As illustrated in FIG. 1 and the like, the lower flange 36 extends radially outward from an axially lower end portion of an outer peripheral surface of the lower tubular portion 32. The housing 30 includes the lower flange 36 that extends radially outward from an outer peripheral surface of the axially lower end portion of the lower tubular portion 36. The lower flange 36 has a square shape when viewed from the axial direction (see FIG. 5). The lower flange 36 includes a first lower flange portion 361, a second lower flange portion 362, a first lower mounting hole 363, and a second lower mounting hole 364.

The lower flange 36 is disassembled into the first lower flange 361 and the second lower flange 362. The first lower flange 361 is included in the first member 30*a*, and the second lower flange 362 is included in the second member 30*b*. That is, the lower flange 36 is divided into the first lower flange 361 included in the first member 30*a* and the second lower flange 362 included in the second member 30*b*.

When the lower flange 36 is viewed in the axial direction, the first lower flange 361 and the second lower flange 362 each have an opposite side. Then, a parting portion is provided in each side other than the opposite side. One (the fourth parting portion Bn22) of two parting portions in the circumferential direction of the lower flange 36 is disposed at a position close to the opposite side of the first lower flange 361 of the two opposite sides of the first lower flange 361 and second lower flange 36. The other (the third parting portion Bn21) of the two parting portions of the lower flange 36 is disposed at a position close to the opposite side of the second lower flange 362 of the two opposite sides of the first lower flange 361 and second lower flange 36.

The lower flange 36 includes two first lower mounting holes 363 and two second lower mounting holes 364. The two first lower mounting holes 363 are disposed near two respective corners adjacent to each other of the lower flange 36. The second lower mounting holes 364 are disposed near two respective other corners of the lower flange 36. The two first lower mounting holes 363 are disposed in the first lower flange 361. The two second lower mounting holes 364 are disposed in the second lower flange 362.

Into each of the first lower mounting holes 363 and the second lower mounting holes 364, a fixture (not illustrated) such as a bolt is inserted. When bolts are screwed into respective female screws (not illustrated) provided in an external device (not illustrated) with the blower 100 to be attached, the blower 100 is fixed to the external device. That is, the first lower flange 361 includes the plurality of first lower mounting holes 363 each for attaching a fixture, and the second lower flange 362 includes the plurality of second lower mounting holes 364 each for attaching a fixture.

The second member 30*b* has an inner peripheral surface including a radially inner surface of the second upper tubular divided body 312, the radially inner surface being provided at its upper end with the second holder 39 recessed radially outward. Into the second holder 39, the first support frame 331 of the first member 30*a* is partly inserted. That is, the second member 30*b* includes the second holder 39 that is formed at the upper end of the radially inner surface of the second upper tubular divided body 312 and that is recessed radially outward to accommodate a part of the first support frame 331.

The second holder 39 is formed with the second through portion 391 that passes through the second holder 39 in the radial direction. Into the second through portion 391, the first protrusion 335 provided on a radially outer surface of the first support frame 331 is inserted. That is, the second holder 39 includes the second through portion 391 passing through the second holder 39 in the radial direction, and the radially outer surface of the first support frame 331 includes the first protrusion 335 that is insertable into the second through portion 391. When the first support frame 331 is inserted into the second holder 39, the first member 30*a* can be axially positioned with respect to the second member 30*b*. Additionally, the first member 30*a* can be firmly combined with the second member 30*b*. When the first protrusion 335 is inserted into the second through portion 391, circumferential displacement can be reduced.

The housing 30 includes a central flange 37 that extends radially from an outer peripheral surface of a central portion of the housing 30 in the axial direction. The central flange 37 has a square shape when viewed from the axial direction. The central flange 37 has a first central flange 371, a second central flange 372, a first central mounting hole 373, and a second central mounting hole 374.

The central flange 37 is separable into the first central flange 371 and the second central flange 372. The first central flange 371 is included in the first member 30*a*. The second central flange 372 is included in the second member 30*b*. The first central flange 371 and the second central flange 372 are equal in size when viewed from the axial direction. The term, "equal in size" includes not only a case where they are completely equal in size but also a case where they are substantially equal in size. That is, the housing 30 includes the first central flange 371 extending radially outward on an outer peripheral surface of an axially intermediate portion of the first member 30*a*, and the second central flange 372 extending radially outward on an outer peripheral surface of an axially intermediate portion of the second member 30*b*. The axially intermediate portion may be positioned at the center in the axial direction or may be positioned out of the center.

There is provided a plurality (two, herein) of not only the first central mounting holes 373 but also the second central mounting holes 374. The two first central mounting holes 373 and the two second central mounting holes 374 are disposed near respective corners of the central flange 37 in a square shape when viewed from the axial direction.

The central flange 37 according to the present example embodiment includes the two first central mounting holes 373 disposed near adjacent respective corners, and the two second central mounting holes 374 disposed near adjacent respective other corners. The first central mounting holes 373 are included in the first central flange 371, and the second central mounting holes 374 are included in the second central flange 372. That is, the first central flange 371 includes the plurality of first central mounting holes 373, and the second central flange 372 includes the plurality of second central mounting holes 374.

The first central mounting holes 373 and the second central mounting holes 374 are used for fastening together with at least one of a set of the first upper mounting holes 353 and the second upper mounting holes 354, and a set of the first lower mounting holes 363 and the second lower mounting holes 364. This enables the blower 100 to be firmly fixed to the external device.

As described above, the upper flange 35, the lower flange 36, and the central flange 37 are each in a square shape, and are aligned in shape when viewed from the axial direction. However, placement is not limited to this, and the flanges may not be aligned in shape when viewed from the axial direction. The shape is not limited to a square, and may be a polygon such as a hexagon or an octagon. Each flange is provided in its each corner with a mounting hole. Each flange may be circular, oval, or the like. Even in these cases, at least two mounting holes may be provided in respective portions of each flange, divided into the first member and the second member.

As described above, the housing 30 is separable into the first member 30*a* and the second member 30*b*. The first member 30*a* and the second member 30*b* are configured to be movable in a direction orthogonal to the central axis J1 to be able to be combined or divided.

The first member 30*a* includes the first upper tubular divided body 311, the first lower tubular divided body 321, the first fan support 33, the first upper flange 351, the first lower flange 361, and the first central flange 371. The second member 30*b* includes the second upper tubular divided body 312, the second lower tubular divided body 322, the second fan support 34, the second upper flange 352, the second lower flange 362, and the second central flange 372.

That is, the housing 30 is separable into the first member 30*a* including the first upper tubular divided body 311, the first lower tubular divided body 321, and the first fan support 33, and the second member 30*b* including the second upper tubular divided body 312, the second lower tubular divided body 322, and the second fan support 34.

The upper tubular portion 31 is circumferentially divided into the first upper tubular divided body 311 and the second upper tubular divided body 312 at the first parting portion Bn11 and the second parting portion Bn12. The lower tubular portion 32 is circumferentially divided into the first lower tubular divided body 321 and the second lower tubular divided body 322 at the third parting portion Bn21 and the fourth parting portion Bn22. That is, the upper tubular portion 31 is separable into the first upper tubular divided body 311 and the second upper tubular divided body 312 in the circumferential direction. The lower tubular portion 32 is separable into the first lower tubular divided body 321 and the second lower tubular divided body 322 in the circumferential direction.

The housing 30 has a structure in which the first member 30*a* and the second member 30*b* are acquired by dividing the upper tubular portion 31 and the lower tubular portion 32 in the circumferential direction, so that parting portions (combined portions) of the housing 30 are distributed more widely than a structure in which the upper tubular portion 31 and the lower tubular portion 32 are divided in the axial direction. Thus, a stress is less likely to concentrate on the parting portions, so that the housing 30 can be increased in strength.

As illustrated in FIGS. 1 and 3, and the like, the first parting portion Bn11 and the third parting portion Bn21 are formed at respective positions aligned in the axial direction. The first parting portion Bn11 of the upper tubular portion 31 is formed with a first conductive wire drawing portion 313, and the first conductive wire 1131 connected to the first circuit board 113 is drawn out. The third parting portion Bn21 of the lower tubular portion 32 is also formed with a second conductive wire drawing portion 323, and a second conductive wire 2131 connected to the second circuit board 213 is drawn out. The first conducting wire drawing portion 313 and the second conducting wire drawing portion 323 are formed at respective positions aligned in the axial direction. This facilitates handling of the first conductive wire 1131 and the second conductive wire 2131 after being drawn out of the housing 30, so that time and manpower for processing the conductive wires can be saved.

The first conducting wire drawing portion 313 and the second conducting wire drawing portion 323 are formed side by side in the axial direction in the housing 30. Thus, when the first circuit board 113 and the second circuit board 213 are provided with connectors facing the first conducting wire drawing portion 313 and the second conducting wire drawing portion 323, respectively, the first circuit board 113 and the second circuit board 213 can be connected from outside the housing 30 using a common connector. That is, the first circuit board 113 and the second circuit board 213 may be connected by the same connector. When one connector connects not only the first conductor 1131 and the first circuit board 113, but also the second conductor 2131 and the second circuit board 213, electrical connection to an external device is facilitated.

In contrast, the second parting portion Bn12 and the fourth parting portion Bn22 are formed at different positions in the circumferential direction when viewed in the axial direction (see FIGS. 4 and 5). That is, when viewed from the axial direction, at least one end at the second parting portion Bn12 of opposite ends in the circumferential direction of the first upper tubular divided body 311 is not aligned with any opposite ends in the circumferential direction at the respective third parting portion Bn21 and fourth parting portion Bn22 of the first lower tubular divided body 321. The second parting portion Bn12 and the fourth parting portion Bn22 are displaced from each other in the circumferential direction, so that a stress can be distributed in the circumferential direction without being concentrated on the parting portions of the first member 30*a* and the second member 30*b*. This enables the housing 30 to be increased in strength.

The housing 30 is assembled as follows. As illustrated in FIGS. 6 and 7, a part of a lower surface in the axial direction of the first support frame 331 and a part of an upper surface in the axial direction of the second support frame 341 are axially opposed to each other, and then one or both of the first member 30*a* and the second members 30*b* are moved in a direction orthogonal to the central axis J1 to approach each other.

When the first member 30*a* and the second member 30*b* approach each other within a predetermined distance, a part of the first support frame 331 of the first member 30*a* (a leading end in the moving direction described above) is inserted into the second holder 39 of the second member 30*b*. Similarly, a part of the second support frame 341 of the second member 30*b* (a leading end in the moving direction described above) is inserted into the first holder 38 of the first member 30*a*.

When a distance between the first member 30*a* and the second member 30*b* further decreases, the first protrusion 335 provided on an outer peripheral surface of the first support frame 331 is inserted into the second through portion 391 of the second holder 39. Further moving allows the first upper tubular divided body 311 and the second upper tubular divided body 312 to be combined with each other to form the upper tubular portion 31. At the same time, the first lower tubular divided body 321 and the second lower tubular divided body 322 are also combined with each other to form the lower tubular portion 32.

When the first member 30*a* and the second member 30*b* are completely combined with each other, the centers of the first bearing holder 334 and the second bearing holder 344 are aligned with the central axis J1. This allows each of the first fan unit 10 and the second fan unit 20 to have the center aligned with the central axis J1 and to be rotatable about the central axis J1.

When the blower 100 is assembled, the first member 30*a* and the second member 30*b* are combined with each other as described above with the first fan unit 10 attached to the first fan support 33 of the first member 30*a*, and the second fan unit 20 attached to the second fan support 34 of the second member 30*b*. As illustrated in FIG. 5 and the like, the third parting portion Bn21 and the fourth parting portion Bn22 at which the lower tubular portion 32 is divided are disposed on opposite sides across the central axis J1. Thus, depending on the moving direction, the first lower tubular divided body 321 may interfere with the second impeller 22 of the second fan unit 20.

For this reason, when the blower 100 is assembled, the first member 30*a* and the second member 30*b* are moved in a direction orthogonal to a line connecting a radially inner edge of the third parting portion Bn21 and a radially inner edge of the fourth parting portion Bn22 when viewed in the axial direction to be combined with each other. Here, the term, "orthogonal" includes a substantially orthogonal. Then, the first protrusion 335, the second protrusion 345, the first holder 38, the first through portion 381, and the second holder 39 may be determined in shape.

When the first fan unit 10 is attached to the first fan support 33 of the first member 30*a*, a part of the first fan unit 10 in the circumferential direction is covered with the first upper tubular divided body 311. That is, when the first fan unit 10 is attached to the first member 30*a*, a radial exterior of the first fan unit 10 is partly exposed radially. Thus, the first fan unit 10 can be easily adjusted for balance while the first fan unit 10 is attached to the first member 30*a*.

The same applies to the second fan unit 20. That is, when the second fan unit 20 is attached to the second fan support 34 of the second member 30*b*, a part of the second fan unit 20 in the circumferential direction is covered with the second lower tubular divided body 322. In other words, when the second fan unit 20 is attached to the second member 30*b*, a radial exterior of the second fan unit 20 is partly exposed radially. Thus, the second fan unit 20 can be easily adjusted for balance while the second fan unit 20 is attached to the second member 30*b*.

The first fan unit 10 and the second fan unit 20 can be adjusted for balance in a state close to an actual driving state, so that the first fan unit 10 and the second fan unit 20 can be stably and smoothly rotated. This allows each of the first fan unit 10 and the second fan unit 20 to be less likely to generate an airflow that is uneven in flow velocity or pressure, so that air blowing efficiency thereof is increased.

In addition, the housing 30 (the blower 100) can be assembled by sliding the first member 30*a* and the second member 30*b* in a direction intersecting the central axis. That is, the housing 30 can be assembled by movement in one axial direction to facilitate its assembly. The assembly includes no complicated operation such as twisting, and thus is advantageous for its automation.

As described above, the blower 100 assembled is fixed to an external device (not illustrated) with a fixture such as a bolt. For example, a bolt is inserted through the first upper mounting hole 353 of the upper flange 35, the first central mounting hole 373 of the central flange 37, and the first lower mounting hole 363 of the lower flange 36 in this order, and is fixed to the external device by screwing. Similarly, a bolt is inserted through the second upper mounting hole 354 of the upper flange 35, the second central mounting hole 374 of the central flange 37, and the second lower mounting hole 364 of the lower flange 36 in this order, and is fixed to the external device by screwing.

There may be provided a tube that is disposed between the upper flange 35 and the central flange 37, and that is axially aligned with the first upper mounting hole 353 of the upper flange 35 and the first central mounting hole 373 of the central flange 37. In addition, there may be provided a tube that is axially aligned with the second upper mounting hole 354 of the upper flange 35 and the second central mounting hole 374 of the central flange 37. Further, there may be provided a tube that is disposed between the lower flange 36 and the central flange 37, and that is axially aligned with the first lower mounting hole 363 of the lower flange 36 and the first central mounting hole 373 of the central flange 37.

Furthermore, there may be provided a tube that is axially aligned with the second lower mounting hole 364 of the lower flange 36 and the second central mounting hole 374 of the central flange 37. Providing these tubes enables each flange to be reinforced, and fixing at the time of screwing to be performed more firmly. Each tube may be integral with the housing 30 or may be a member independent of the housing 30. The member independent of the housing 30 may be preliminarily fixed to the housing 30 by using a fixing method other than the bolt for fixing described above.

The blower 100 is attached to the external device with the lower flange 36 in contact with or close to the external device. The bolts pass through the upper flange 35, the central flange 37, and the lower flange 36, so that the blower 100 is firmly fixed. Thus, the fixing of the blower 100 is unlikely to be loosened even when a force due to vibration during operation, pressure fluctuations in an airflow, or the like is applied. This allows the blower 100 to blow air stably over a long period of time.

The bolts may pass therethrough in the reverse order to bring the upper flange 35 into contact with the external device.

The housing 30 is configured to be divided along a cutting plane along its axis. Thus, even when an external force such as vibration or impact is applied to the blower 100, an upper blower section including the upper tubular portion 31 and the first fan unit 10, and a lower blower section including the lower tubular portion 32 and the second fan unit 20 are not separated from each other. For this reason, even when only one of the upper flange 35 and the lower flange 36 is fixed to the external device, the blower 100 is not separated. This allows the blower 100 to operate stably over a long period of time.

Figure 8:
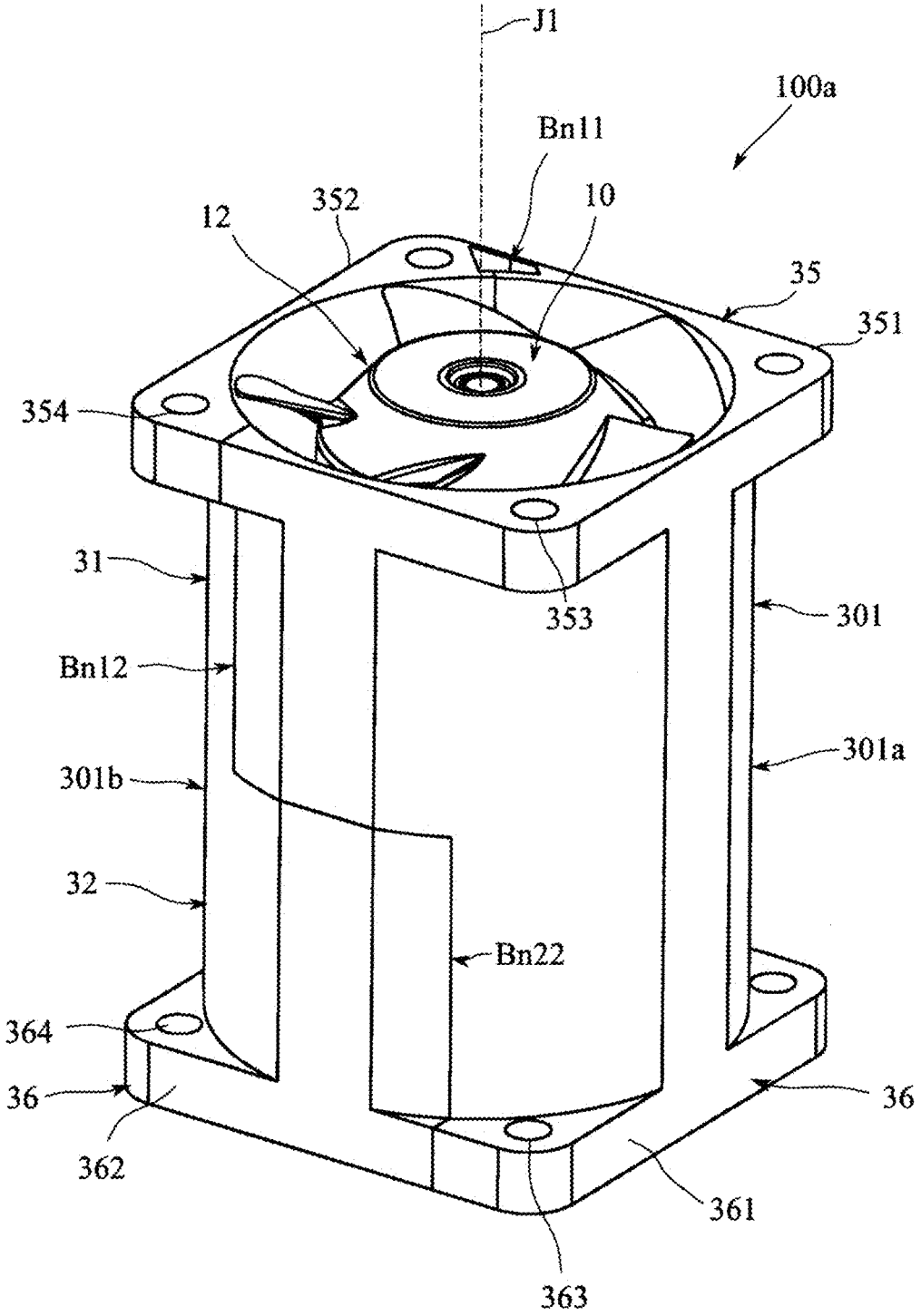
FIG. 8 is a perspective view of a first modification of a blower according to an example embodiment of the present disclosure.

A modification of the blower according to the present example embodiment will be described with reference to the drawings. FIG. 8 is a perspective view of a first modification of the blower according to the present disclosure. FIG. 8 illustrates a blower 100*a* that differs from the blower 100 in that a housing 301 does not include a central flange 37. Besides this, the blower 100*a* has the same configuration as the blower 100. Thus, a portion of the blower 100*a* that is substantially the same as that of the blower 100 is denoted by the same reference numeral, and duplicated detailed description of the same portion is eliminated.

When the blower 100*a* can be firmly fixed with an upper flange 35 and a lower flange 36 of the housing 301 due to a small force applied, a small vibration, and the like, the central flange may be eliminated as illustrated in FIG. 8. As illustrated in FIG. 8, the housing 301 of the blower 100*a* includes a first member 301*a* and a second member 301*b*. The first member 301*a* includes a first upper flange 351 and a first lower flange 361. The second member 301*b* includes a second upper flange 352 and a second lower flange 362.

When the central flange is eliminated, the first member 301*a* and the second member 301*b* are simplified in shape. This enables reduction in manufacturing cost of the first member 301*a* and the second member 301*b*. When the central flange is eliminated, a space between the upper flange 35 and the lower flange 36 on an outer peripheral surface of the housing 301 is increased to allow increase in degree of freedom of handling of a first conducting wire 1131 and a second conducting wire 2131. This reduces restriction on a space for mounting the blower 100*a*, so that the blower 100*a* is improved in versatility.

Figure 9:
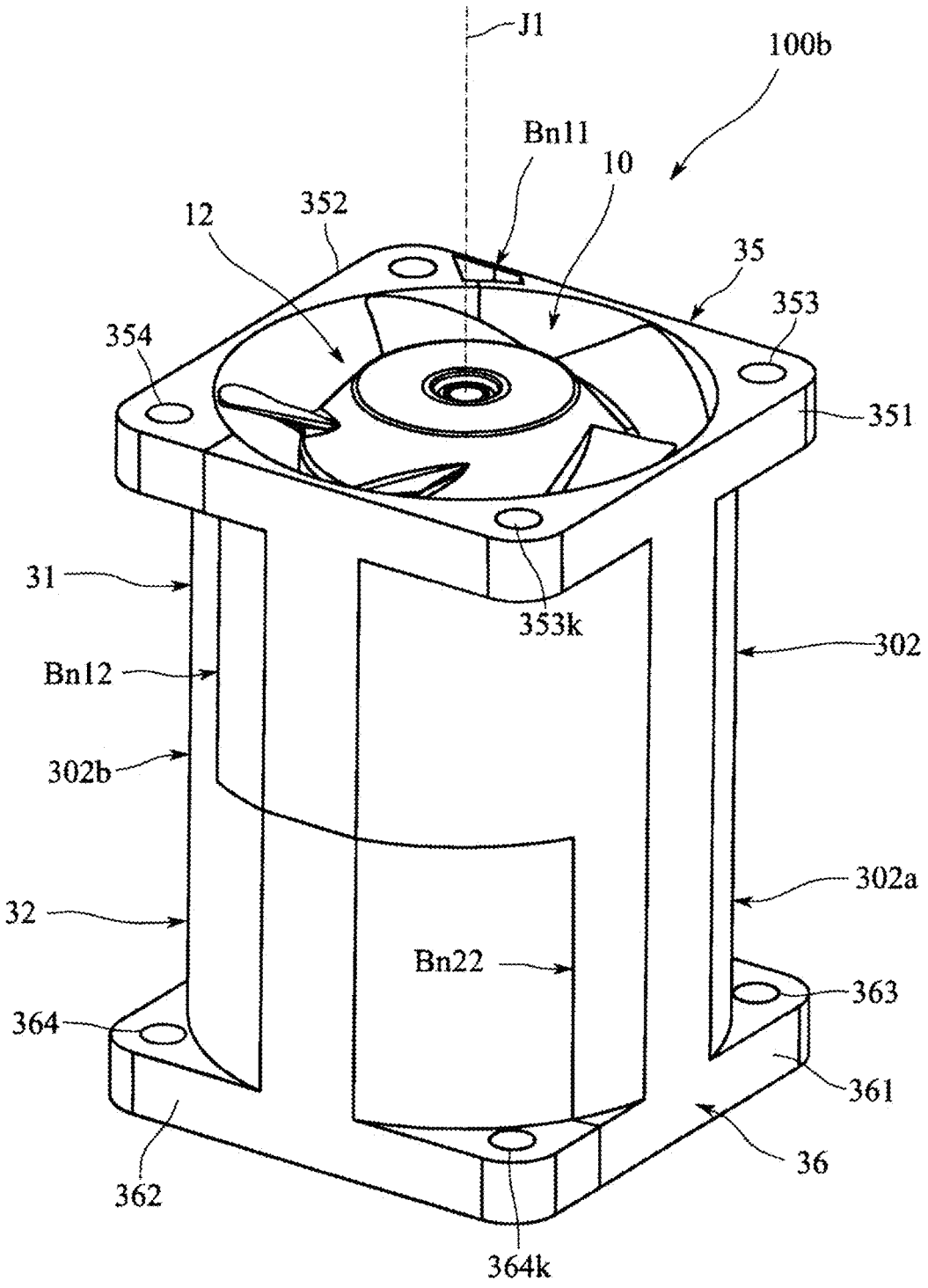
FIG. 9 is a perspective view of a second modification of a blower according to according to an example embodiment of the present disclosure.

A modification of the blower according to the present example embodiment will be described with reference to the drawings. FIG. 9 is a perspective view of a second modification of the blower according to the present disclosure. FIG. 9 illustrates a blower 100*b* that differs in position of a fourth parting portion Bn22 from the blower 100*a* illustrated in FIG. 8. Besides this, the blower 100*b* has the same configuration as the blower 100*a*. Thus, a portion of the blower 100*b* that is substantially the same as that of the blower 100*a* is denoted by the same reference numeral, and duplicated detailed description of the same portion is eliminated.

The blower 100*b* includes a housing 302 that differs in position of the fourth parting portion Bn22 from the housing illustrated in FIGS. 1 to 8. Thus, the lower flange 36 differs in divided position, and includes a second lower mounting hole 364*k* serving as the first lower mounting hole 363 of the blower 100*a*. Then, a first upper mounting hole 353*k* and the second lower mounting hole 364*k* are aligned with each other in the axial direction.

When a bolt is inserted through both the first upper mounting hole 353*k* and the second lower mounting hole 364*k*, a first member 302*a* and a second member 302*b* can be bolted together. That is, the housing 302 may include a second lower mounting hole 364 that is aligned with at least one first upper mounting hole 353 when viewed in the axial direction, or a second upper mounting hole 363 that is aligned with at least one second upper mounting hole 354 when viewed in the axial direction.

This enables the blower 100*b* to be more firmly fixed to an external device. While in the present modification, the first upper mounting hole 353*k* and the second lower mounting hole 364*k* are aligned with each other when viewed from the axial direction, the housing 302 is not limited to this. For example, the housing 302 may include a second upper mounting hole and a first lower mounting hole that are aligned with each other when viewed from the axial direction.

While in the present modification, the configuration without a central flange is described, a configuration with the central flange may be employed. At this time, the central flange may include a first central mounting hole or a second central mounting hole that is aligned with the first upper mounting hole 353*k* and the second lower mounting hole 364*k* when viewed from the axial direction. The placement as described above enables the housing 302 to be fixed more firmly. As described above, the first upper mounting hole 353, the second lower mounting hole 364, and the first central mounting hole or the second central mounting hole of the central flange may be aligned with each other when viewed from the axial direction.

That is, the housing 302 includes at least one first upper mounting hole 353, and the second lower mounting hole 364 aligned with a first central mounting hole 373 or a second central mounting hole 374 when viewed in the axial direction, or includes at least one second upper mounting hole 354, and the first lower mounting hole 363 aligned with the first central mounting hole 373 or the second central mounting hole 374 when viewed in the axial direction. When the housing 302 is configured as described above, the first member 302*a* and the second member 302*b* are fastened together, and a central flange 37 is also fastened together. This enables the housing 302 to be more firmly fixed.

Figure 10:
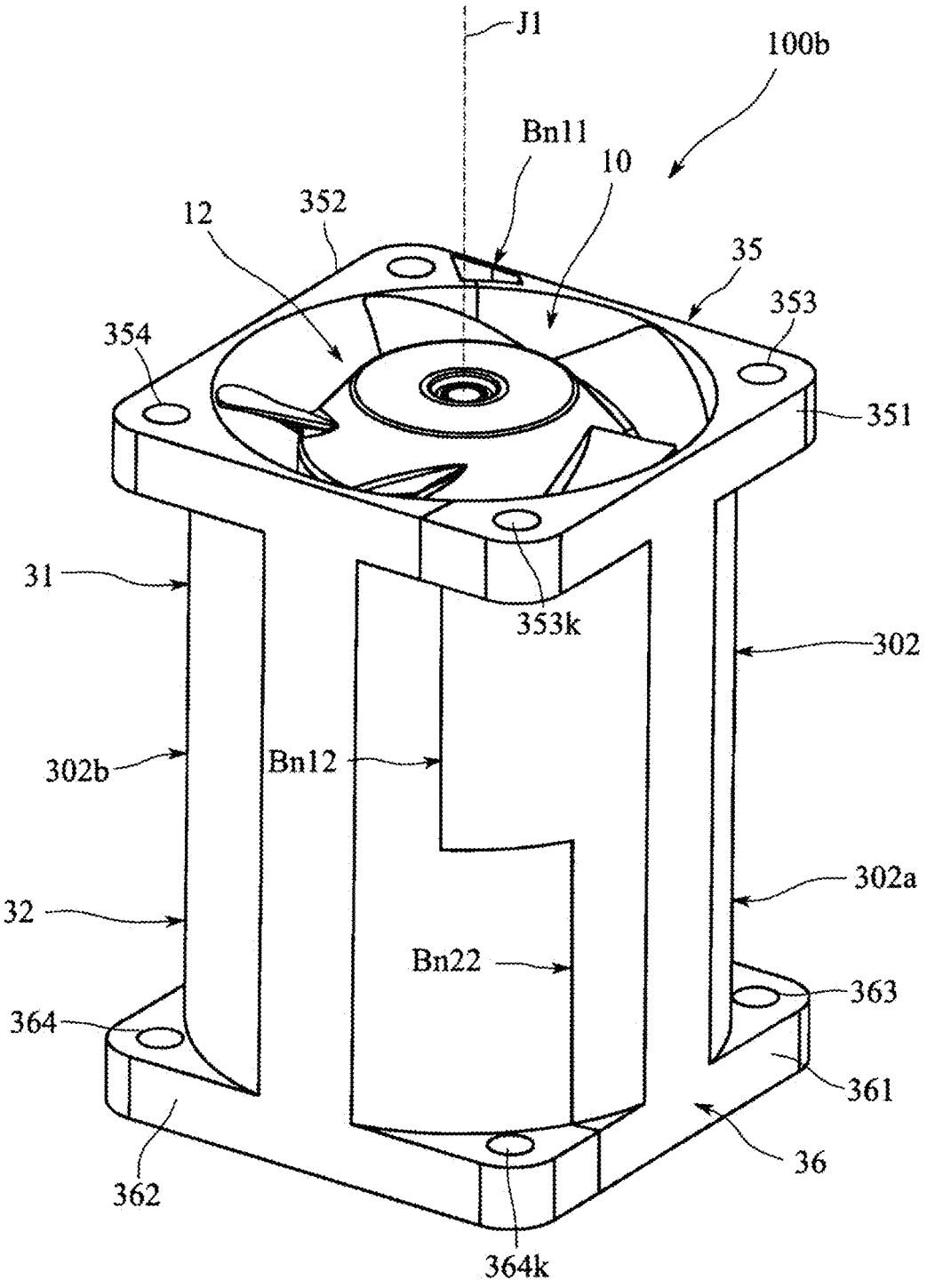
FIG. 10 is a perspective view of a third modification of the blower according to according to an example embodiment of the present disclosure.

A modification of the blower according to the present example embodiment will be described with reference to the drawings. FIG. 10 is a perspective view of a third modification of the blower according to the present disclosure. FIG. 10 illustrates a blower 100*b* in which a second parting portion Bn12 is formed closer to a corner where a first mounting hole 353*k* is formed than the center of a side of an upper flange 35 when viewed from the axial direction. When the second parting portion Bn12 is formed as described above, the second parting portion Bn12 and a fourth parting portion Bn22 are identical in placement to a first parting portion Bn11 and a third parting portion Bn21. This facilitates assembly of a housing 302. When the housing 302 is viewed in the axial direction, the side of the upper flange 35 has a thin central portion. When the second parting portion Bn12 is changed in position as illustrated in FIG. 10, a parting line does not pass through the thin portion, and thus the housing 302 can be increased in strength.

Figure 11:
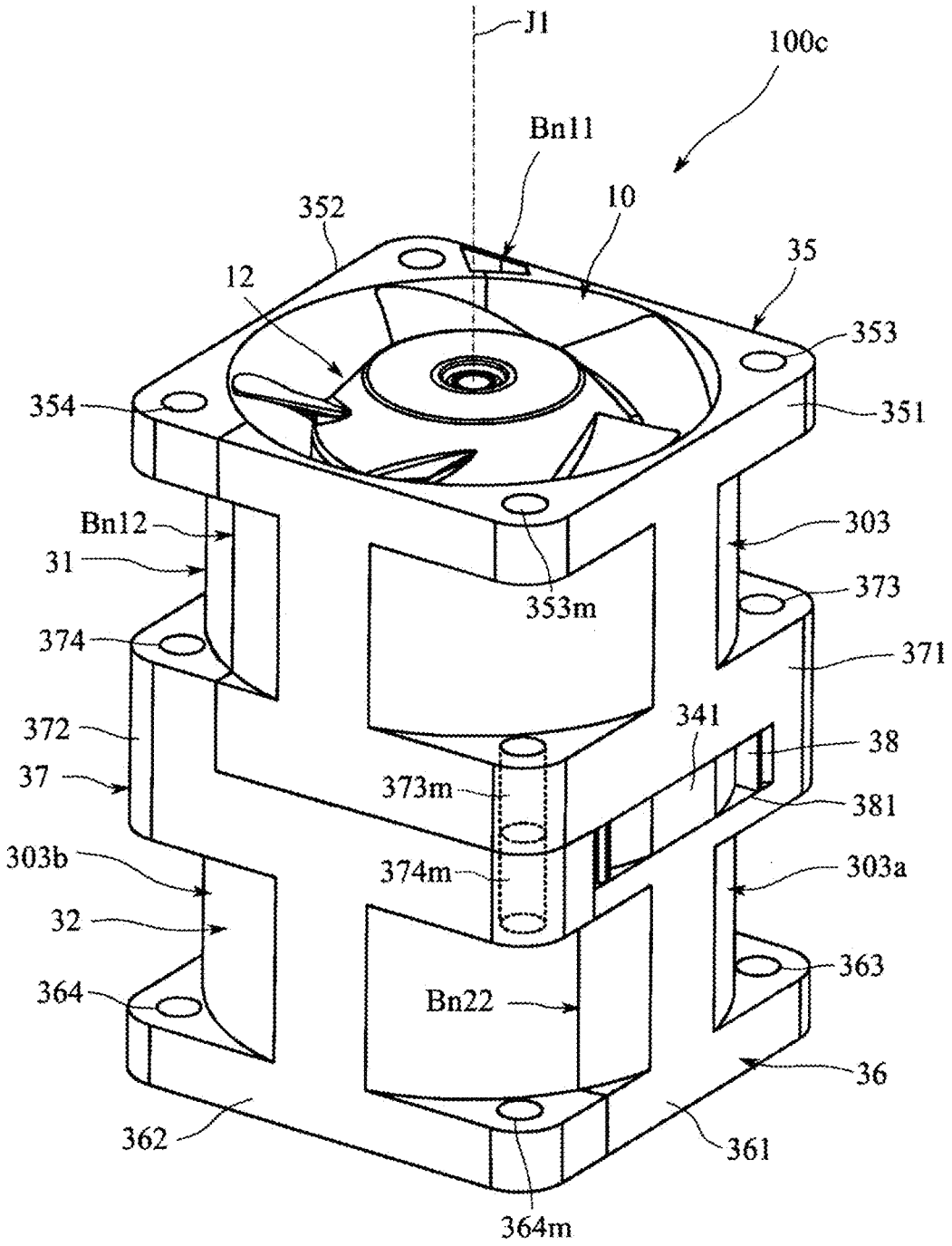
FIG. 11 is a perspective view of a fourth modification of the blower according to according to an example embodiment of the present disclosure.

A modification of the blower according to the present example embodiment will be described with reference to the drawings. FIG. 11 is a perspective view of a fourth modification of the blower according to the present disclosure. FIG. 11 illustrates a blower 100*c* that differs in position of a fourth parting portion Bn22 from the blower 100 illustrated in FIG. 1. Besides this, the blower 100*c* has the same configuration as the blower 100. Thus, a portion of the blower 100*c* that is substantially the same as that of the blower 100 is denoted by the same reference numeral, and duplicated detailed description of the same portion is eliminated.

FIG. 11 illustrate a housing 303 in which a part of a central flange 37 is vertically divided, and a part of a first central flange 371 and a part of a second central flange 372 are fitted to each other in the axial direction. More specifically, a part of the first central flange 371 is disposed axially on a part of the second central flange 372. Then, the first central flange 371 includes a first central mounting hole 373*m* that is aligned with a second central mounting hole 374*m* provided in the second central flange 372 in the axial direction. That is, at least one first central mounting hole 373 and at least one second central mounting hole 374 are aligned with each other when viewed in the axial direction.

As illustrated in FIG. 11, a first upper mounting hole 353*m* provided in a first upper flange 351, the first central mounting hole 373*m* provided in the first central flange 371, the second central mounting hole 374*m* provided in the second central flange 372, and a second lower mounting hole 364*m* provided in a second lower flange 262, are aligned with each other in the axial direction.

This enables the flanges to be fastened together by inserting a bolt through the first upper mounting hole 353*m*, the first central mounting hole 373*m*, the second central mounting hole 374*m*, and the second lower mounting hole 364*m*. That is, the housing 303 includes a first member 303*a* and a second member 303*b* that are fastened together. This enables the housing 303 to be firmly fixed.

While the example embodiments of the present disclosure have been described above, the example embodiments can be modified in various ways within the scope of the present disclosure.

The blower according to the present disclosure may be used as a blower that sends air to electronic components disposed inside devices, such as a computer, a network communication device, and a server to cool the electronic components.

Features of the above-described preferred example embodiments and the modifications thereof may be combined appropriately as long as no conflict arises.

While example embodiments of the present disclosure have been described above, it is to be understood that variations and modifications will be apparent to those skilled in the art without departing from the scope and spirit of the present disclosure. The scope of the present disclosure, therefore, is to be determined solely by the following claims.

What is claimed is:

1. A blower comprising:

a first fan to generate an airflow flowing in a direction along a central axis extending vertically;

a second fan that is disposed axially below and coaxially with the first fan; and a housing with a tubular shape that extends along the central axis and accommodates the first fan and the second fan;

the housing including:

an upper tubular portion accommodating the first fan;

a lower tubular portion accommodating the second fan;

a first fan support that is disposed at an axially lower end portion of the upper tubular portion to support the first fan; and a second fan support that is disposed at an axially upper end portion of the lower tubular portion to support the second fan;

the upper tubular portion being circumferentially separable into a first upper tubular divided body and a second upper tubular divided body;

the lower tubular portion being separable into a first lower tubular divided body and a second lower tubular divided body;

the housing being separable into:

a first structure including the first upper tubular divided body, the first lower tubular divided body, and the first fan support; and a second structure including the second upper tubular divided body, the second lower tubular divided body, and the second fan support.

2. The blower according to claim 1, wherein the first fan support includes:

a first base to which the first fan is attached;

a first support frame that has an arch shape obtained by cutting a tubular body about the central axis in a circumferential direction, and that couples opposite circumferential ends of an axially lower end portion of the first upper tubular divided body; and a first rib that radially couples the first base to the first support frame; and the second fan support includes:

a second base to which the second fan is attached;

a second support frame that has an arch shape obtained by cutting a tubular body about the central axis in a circumferential direction, and that couples opposite circumferential ends of an axially upper end portion of the second lower tubular divided body; and a second rib that radially couples the second base to the second support frame.

3. The blower according to claim 2, wherein the first structure includes a first holder that is located at an upper end of a radially inner surface of the first lower tubular divided body and that is recessed radially outward to accommodate a portion of the second support frame; and the second structure includes a second holder that is located at a lower end of a radially inner surface of the second upper tubular divided body and that is recessed radially outward to accommodate a portion of the first support frame.

4. The blower according to claim 3, wherein the first holder includes a through portion passing through the first holder in a radial direction; and the radially outer surface of the second support frame includes a protrusion that is insertable into the through portion.

5. The blower according to claim 3, wherein the second holder includes a through portion passing through the second holder in the radial direction; and the radially outer surface of the first support frame includes a protrusion that is insertable into the through portion.

6. The blower according to claim 1, wherein when viewed from an axial direction, at least one of opposite ends in the circumferential direction of the first upper tubular divided body is not aligned with any opposite ends in the circumferential direction of the first lower tubular divided body.

7. The blower according to claim 1, wherein the housing includes:

an upper flange that extends radially outward from an outer peripheral surface of an axially upper end portion of the upper tubular portion; and a lower flange that extends radially outward from an outer peripheral surface of an axially lower end portion of the lower tubular portion;

the upper flange is divided into a first upper flange included in the first structure and a second upper flange included in the second structure; and the lower flange is divided into a first lower flange included in the first structure and a second lower flange included in the second structure.

8. The blower according to claim 7, wherein the first upper flange includes a plurality of first upper mounting holes to mount a fixture;

the second upper flange includes a plurality of second upper mounting holes to mount the fixture;

the first lower flange includes a plurality of first lower mounting holes for mounting the fixture;

the second lower flange includes a plurality of second lower mounting holes for mounting the fixture; and at least one of the second lower mounting holes is aligned with the corresponding one of the first upper mounting holes when viewed in the axial direction, or at least one of the second upper mounting holes is aligned with the corresponding one of the second upper mounting holes when viewed in the axial direction.

9. The blower according to claim 8, wherein the housing includes:

a first central flange extending radially outward on an outer peripheral surface of an axially intermediate portion of the first structure; and a second central flange extending radially outward on an outer peripheral surface of an axially intermediate portion of the second structure;

the first central flange includes a plurality of first central mounting holes;

the second central flange includes a plurality of second central mounting holes;

at least one of the first upper mounting holes is aligned with the corresponding one of the first central mounting holes or of the second central mounting holes, and with the corresponding one of the second lower mounting holes when viewed in the axial direction; or at least one of the second upper mounting holes is aligned with the corresponding one of the first central mounting holes or of the second central mounting holes, and with the corresponding one of the first lower mounting holes when viewed in the axial direction.

10. The blower according to claim 9, wherein at least one of the first central mounting holes and at least one of the second central mounting holes are aligned with each other when viewed in the axial direction.

11. The blower according to claim 1, wherein the first fan includes a first motor, a first impeller, and a first circuit board to supply electric power to the first motor;

the second fan includes a second motor, a second impeller, and a second circuit board to supply electric power to the second motor; and the first circuit board and the second circuit board are connected by a same connector.

* * * * *